US010587063B2

(12) United States Patent
Viloteau et al.

(10) Patent No.: US 10,587,063 B2
(45) Date of Patent: Mar. 10, 2020

(54) SUPPORT ASSEMBLY FOR PRESS-FIT CONTACT PINS

(71) Applicant: Tyco Electronics France SAS, Pontoise (FR)

(72) Inventors: Frederic Nicolas Viloteau, Cergy (FR); Mounir Alaya, St. Ouen L. Aumone (FR); Ngoc Thanh Nguyen, St. Ouen L. Aumone (FR); Alain Dupuis, Jouy-le-Moutier (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 15/939,346

(22) Filed: Mar. 29, 2018

(65) Prior Publication Data

US 2018/0287281 A1 Oct. 4, 2018

(30) Foreign Application Priority Data

Mar. 29, 2017 (FR) ..... 17 52659

(51) Int. Cl.
*H01R 12/72* (2011.01)
*H01R 12/58* (2011.01)
*H01R 13/514* (2006.01)

(52) U.S. Cl.
CPC ..... *H01R 12/724* (2013.01); *H01R 12/585* (2013.01); *H01R 13/514* (2013.01)

(58) Field of Classification Search
CPC .. H01R 12/724; H01R 13/514; H01R 13/502; H01R 12/585; H01R 13/41; H01R 13/422; H01R 13/428; H01R 13/05; H01R 13/518; H01R 9/053
USPC ..... 439/79, 84, 701, 873, 541.5, 733.1, 751, 439/695, 712
See application file for complete search history.

(56) References Cited

U.S. PATENT DOCUMENTS 4,857,017 A * 8/1989 Erk ..... H01R 12/724 439/695
5,639,251 A 6/1997 Harting et al.
(Continued)

FOREIGN PATENT DOCUMENTS

EP 0961366 A2 1/1999
TW M377724 U1 4/2010

OTHER PUBLICATIONS

European Patent Office Communication, European Patent Application No. 18 164 790.0, dated Nov. 12, 2019, 6 pages.

*Primary Examiner* — Travis S Chambers
(74) *Attorney, Agent, or Firm* — Barley Snyder

(57) ABSTRACT

A support assembly comprises a support device and a plurality of press-fit contact pins. The support device has a preformed body with a first row of slits or holes and a second row of slits or holes. The press-fit contact pins each have a contact portion at a first end and a press-fit portion at a second end opposite the first end. Each of the contact pins is disposed in one of the slits or holes of the first row or the second row with the press-fit portion protruding from a first side of the support device and the contact portion protruding from a second side of the support device opposite the first side. The press-fit portions of the contact pins disposed in the first row of slits or holes are aligned with the press-fit portions of the contact pins disposed in the second row of slits or holes.

14 Claims, 6 Drawing Sheets

(56) References Cited

U.S. PATENT DOCUMENTS

| | | | | |
|---|---|---|---|---|
| 6,095,826 | A * | 8/2000 | Potters | H01R 12/724 439/79 |
| 6,179,663 | B1 * | 1/2001 | Bradley | H01R 12/71 439/607.02 |
| 6,565,387 | B2 * | 5/2003 | Cohen | H01R 13/6587 439/108 |
| 6,719,573 | B2 * | 4/2004 | Koehler | H01R 12/585 29/837 |
| 7,210,955 | B2 * | 5/2007 | Ringler | H01R 12/585 439/381 |
| 7,404,744 | B2 * | 7/2008 | Amano | H01R 13/514 439/540.1 |
| 8,876,538 | B2 * | 11/2014 | Shiraishi | H01R 13/516 439/79 |
| 9,048,581 | B2 * | 6/2015 | Briant | H01R 13/639 |
| 2006/0141831 | A1 | 6/2006 | Hsu | |
| 2009/0186533 | A1 | 7/2009 | Tokunaga | |
| 2015/0162683 | A1 | 6/2015 | Hung et al. | |

* cited by examiner

SUPPORT ASSEMBLY FOR PRESS-FIT CONTACT PINS

CROSS-REFERENCE TO RELATED APPLICATION

This application claims the benefit of the filing date under 35 U.S.C. § 119(a)-(d) of French Patent Application No. 1752659, filed on Mar. 29, 2017.

FIELD OF THE INVENTION

The present invention relates to press-fit contact pins and, more particularly, to a support assembly for press-fit contact pins.

BACKGROUND

Electrical connectors with press-fit contact pins are commonly used for assembly with a substrate, such as a printed circuit board. During insertion of the contact pins into corresponding holes of the substrate, a substantial pressure is exerted on the press-fit portion of the pins. It is therefore necessary to mechanically support the press-fit portions of the pins in order to avoid any bending or breaking during the insertion.

In some configurations, a row of press-fit contact pins are placed against a wall of a connector or socket housing. The wall provides mechanical support in the event of pressure being applied onto the press-fit portion. Without the support of the wall, the press-fit portions are in danger of breaking or bending. This is the case, for example, in socket housings used in radar devices in which a press-fit connection must be performed on two rows of four press-fit contact pins; only one row is able to be placed against a wall of the housing, but the other row lacks mechanical support behind the press-fit portions.

To at least partially address this problem, the press-fit contact pins are generally fixed in the electrical connector or in the socket by overmolding methods, making it possible to incorporate the contact pin in the housing of the connector or socket. The overmolding positions plastic material under each of the rows of pins. A pushing effort from the outer wall is thus transmitted to the press-fit contact pins during the insertion into the printed circuit board. Such methods of overmolding, however, are complex and costly. The known overmolding methods include steps of forming the contacts, manipulating the contacts to insert them inside a mold, and the molding. Defects can accumulate in each step of the overmolding method.

Specifically in sockets used for electrical connection in radar applications, in which the socket is connected to a printed circuit board of a radar device, it is known to plate some walls inside the housing of the socket in order to provide the radar with a desired directivity. To do so, methods of vapor-phase deposition of metal particles are commonly used on the walls of the housing. Given that the housing of the socket is manufactured beforehand by overmolding onto the press-fit contact pins, it is imperative to mask every portion of the contact pins which protrudes inside the housing, notably including the press-fit portions, in order to avoid any contamination thereof during the depositing of the metal particles. Given the difficulty of manipulating the interior of the housing of the socket, the complexity and the cost of the masking stage add to the problems of the overmolding method.

It is also known to use a retaining device as an element separate from the socket housing to support the press-fit contact pins. The retaining device consists of a piece overmolded onto the press-fit contact pins, which can be inserted into the socket housing after the vapor-phase deposition step. However, even if it is possible to use the retaining device without the complex and costly step of masking the contact pins during the deposition of the metal particles, the overmolding of the retaining device onto the contact pin remains a complex and costly method. Furthermore, different configurations of the contact pins require different overmolding methods.

SUMMARY

A support assembly comprises a support device and a plurality of press-fit contact pins. The support device has a preformed body with a first row of slits or holes and a second row of slits or holes. The press-fit contact pins each have a contact portion at a first end and a press-fit portion at a second end opposite the first end. Each of the contact pins is disposed in one of the slits or holes of the first row or the second row with the press-fit portion protruding from a first side of the support device and the contact portion protruding from a second side of the support device opposite the first side. The press-fit portions of the contact pins disposed in the first row of slits or holes are aligned with the press-fit portions of the contact pins disposed in the second row of slits or holes.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
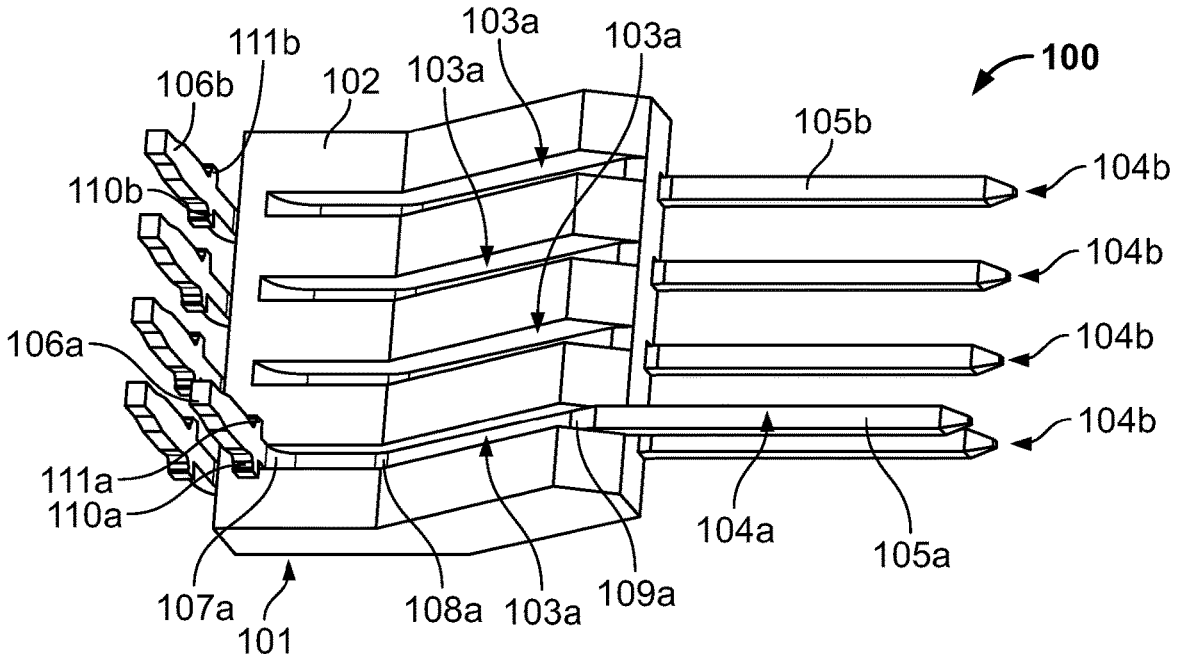
FIG. 1A is a top perspective view of a support assembly according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An embodiment of a support assembly 100 for press-fit contact pins 104*a*, 104*b* is shown in FIGS. 1A-2B. The support assembly 100, as shown in FIGS. 1A and 1B, comprises a support device 101, also referred to as a retaining device, which includes a preformed body 102.

The preformed body 102 of the support device 101, in an embodiment, is formed from a plastic material in a mold using a standard molding technology prior to inserting contact pins 104*a*, 104*b* as described below. In this embodiment, the preformed body 102 is monolithically formed in a single piece and includes a first row of slits 103*a* formed on the upper face of the support device 101, as shown in FIG. 1A, and a second row of slits 103*b* formed on the lower face of the support device 101 shown in FIG. 1B. The first row of slits 103*a* and the second row of slits 103*b* are arranged one above the other in a direction of the depth of the preformed body 102.

Figure 1B:
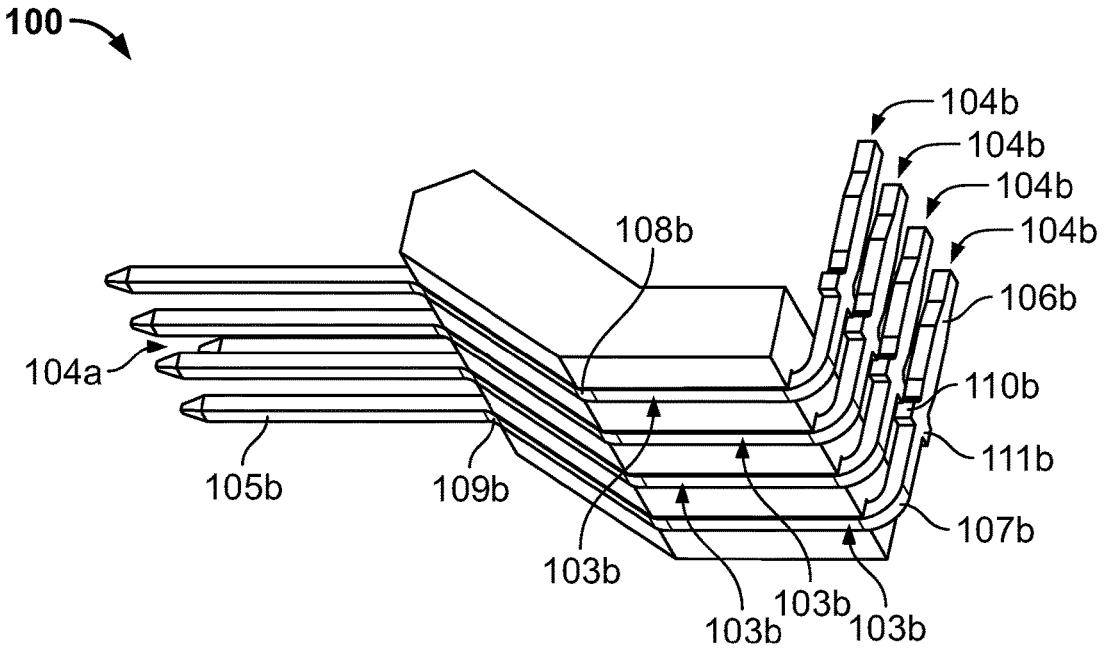
FIG. 1B is a bottom perspective view of the support assembly of FIG. 1A.

The press-fit contact pins 104*a*, 104*b* are accommodated in the slits 103*a*, 103*b* of the support device 101 as shown in FIGS. 1A and 1B. For the sake of clarity, some of the contact pins 104*a* have been concealed in the figures, but it should be understood that each of the slits 103*a*, 103*b* accommodates a respective contact pin 104*a*, 104*b*. Each of the contact pins 104*a* accommodated in the first row of slits 103*a* includes a contact portion 105*a* at a first end which protrudes relative to the support device 101, and which is configured to establish an electrical contact with a matching contact element of an electrical connector. At a second end opposite the first end, each contact pin 104*a* has a press-fit portion 106*a* which protrudes from the opposite side of the support device 101, and which is configured to establish an electrical contact by press-fit or forcible insertion into a substrate, for example, a printed circuit board. In an embodiment, the slits 103*a*, 103*b* have retention members, for example one or more ribs, in order to better hold the contact pin 104*a*, 104*b*.

The contact pins 104*a*, 104*b* are disposed such that the press-fit portions 106*a* of the pins 104*a* in the first row of slits 103*a* are aligned with the press-fit portions 106*b* of the pins 104*b* in the second row of slits 103*b*. As shown in FIGS. 1A and 1B, the slits 103*a* of the first row are aligned with the slits 103*b* of the second row, so that the contact pins 104*a* accommodated in the first row of slits 103*a* are substantially aligned, and therefore substantially parallel in sections, with the contact pins 104*b* in the second row of slits 103*b*. This alignment is in the direction of the depth of the support device 101, as for the contact portions 105*a*, 105*b* shown in FIGS. 1A and 1B. The contact pins 104*a*, 104*b* may also be aligned along a longitudinal direction of the support device 101 perpendicular to the depth of the support device 101, as shown for the press-fit portions 105*a*, 105*b* in FIGS. 1A and 1B. Two rows of contact portions 105*a*, 105*b* establish an electrical contact in the longitudinal direction of the support device 101, and two rows of press-fit portions 106*a*, 106*b* establish an electrical contact via press-fit or forcible insertion in a perpendicular direction to the contact portions 105*a*, 105*b*.

As shown in FIGS. 1A and 1B, between the contact portion 105*a*, 105*b* and the press-fit portion 106*a*, 106*b*, the contact pin 104*a*, 104*b* has one or more bends such that the press-fit portions 106*a*, 106*b* are substantially perpendicular to the contact portions 105*a*, 105*b*. It is thus possible to electrically connect together two elements in a substantially perpendicular configuration. In the shown embodiment, the contact pins 104*a* of the upper row include three bends 107*a*, 108*a*, 109*a*, and the contact pins 104*b* of the lower row also include three bends 107*b*, 108*b*, 109*b*. In other embodiments, the contact pins 104*a* of the upper row have a different number of bends relative to the contact pins of the lower row. In all embodiments, the rows of slits 103*a*, 103*b* are preformed so as to accommodate the desired configuration of the contact pins 104*a*, 104*b* and may therefore also have bends as shown in FIGS. 1A and 1B.

On an assembly line, a row of contact pins 104*a* and/or 104*b* may be cut out, then bent or arched in accordance with a desired shape or shapes. The support device 101 is supplied to the line and the row of contact pins 104*a* or 104*b* is inserted into the corresponding slits 103*a* or 103*b* of the first row on a first side of the preformed body 102. The preformed body 102 is then turned over in order to allow the insertion of the other row of contact pins in the corresponding slits of the second row. The cutting out and arching of the two rows of contact pins 104*a*, 104*b* may be performed in one step or sequentially, with the cutting-out and arching of the second set of contact pins being performed after the insertion of the pins in the first row of slits, for example, after having turned over the device 101. In an embodiment, the assembly of the support assembly 100 is automated, for example, by automatic "pick-and-place"-type operations for installing components, considerably reducing the time necessary to manufacture the support assembly 100 compared to overmolding.

Figure 2A:
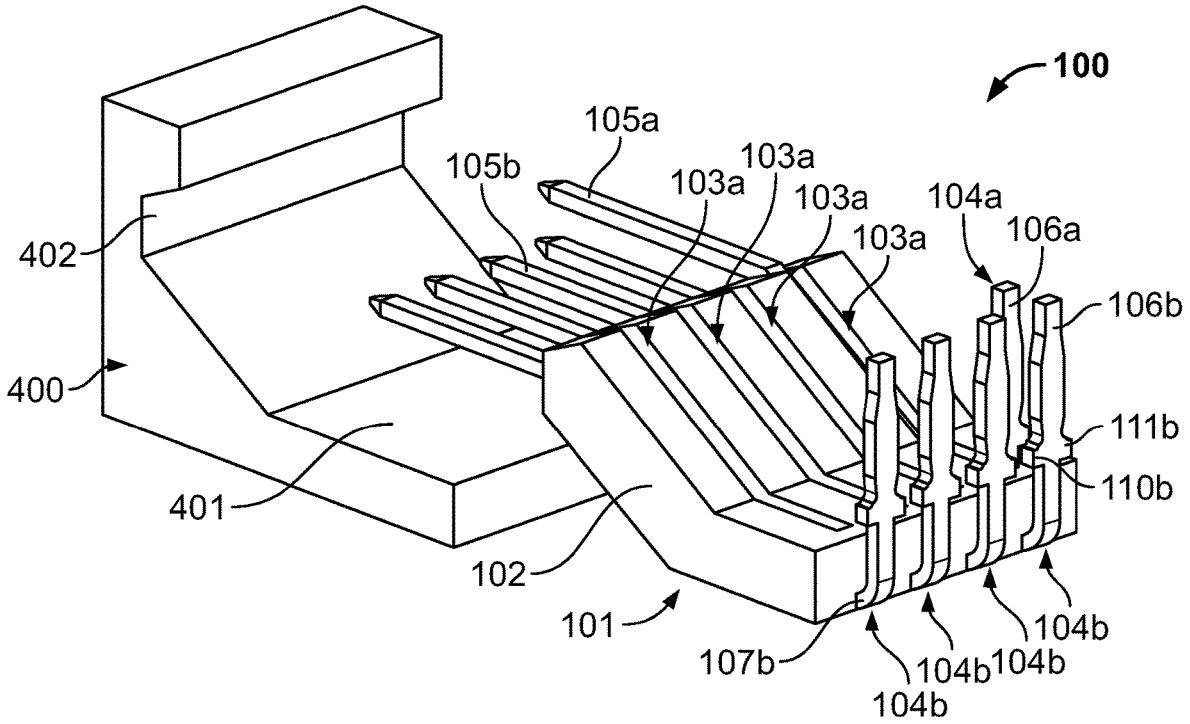
FIG. 2A is a perspective view of the support assembly of FIG. 1A prior to insertion into a housing.
Figure 2B:
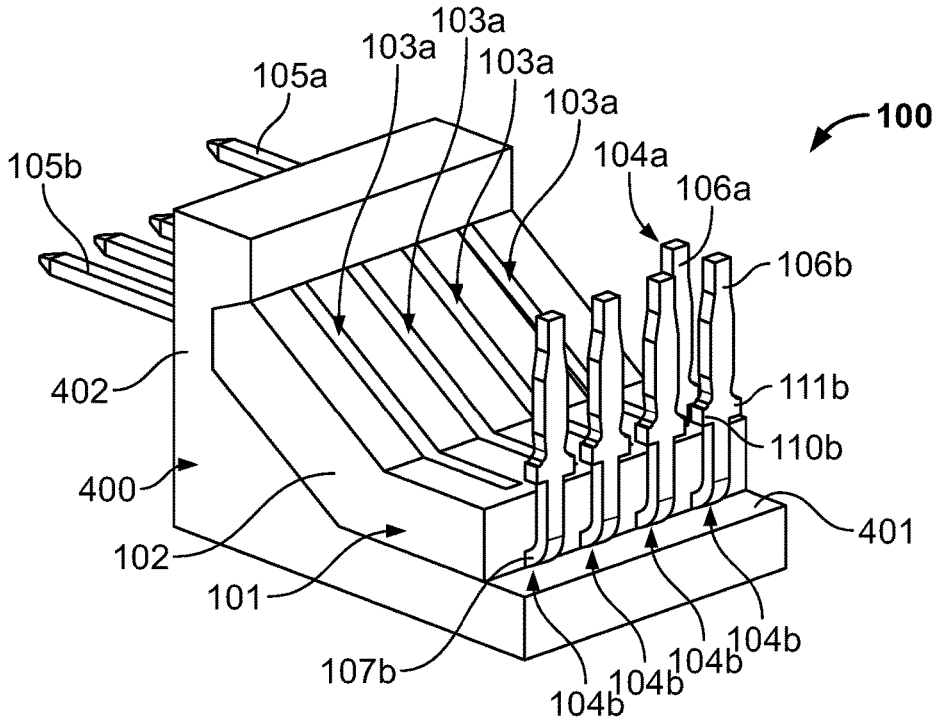
FIG. 2B is a perspective view of the support assembly of FIG. 1A after insertion into the housing.

As shown in FIGS. 2A and 2B, the support assembly 100 is used in a housing 400 of an electrical connector. In the embodiment shown in FIGS. 2A and 2B, the connector is a socket receiving a substrate such as a printed circuit board. The housing 400 has a bottom wall 401 and a contact wall 402. The contact wall 402 has an opening receiving the two rows of contact elements 105*a*, 105*b* of the contact pins 104*a*, 104*b* of the assembly 100, which extend through the contact wall 402.

The support assembly 100 is moved into the housing 400 until it rests substantially on the bottom wall 401. In the orientation of the FIGS. 2A and 2B, the support assembly 100 is introduced vertically onto the housing 400. A face of the support device 101 having the second row of slits 103*b* abuts the bottom wall 401. As FIG. 2B then shows, the support assembly 100 may then be slid, in particular horizontally in the orientation of FIGS. 2A and 2B, up to a position in abutment against the contact wall 402 such that the two rows of contact elements 105*a*, 105*b* protrude through the contact wall 402. In an embodiment, to ensure the holding of the support assembly 100 thus mounted in the housing 400, the support device 101 and/or the housing 400 may have complementary locking devices.

The contact pins 104*a*, 104*b* are configured such that a substrate such as a printed circuit board may be introduced into the housing 400, vertically in the orientation of FIGS. 2A and 2B, and connected by a press-fit with the press-fit portions 106*a*, 106*b*. The support assembly 100 supplies the necessary mechanical support to the press-fit portions 106*a*, 106*b* to withstand the force exerted during the press-fitting. The press-fit portions 106*a* of the contact pins 104*a* of the upper row of slits 103*a* are set back in the direction of the wall 402 relative to the press-fit portions 106*b* of the contact pins 104*b* of the lower row of slits 103*b*, which are further spaced apart from the wall 402. Having the support device 101 abut the bottom wall 401 ensures that the press-fit portions 106*b* of the contact pins 104*b* of the lower row of slits 103*b* are mechanically supported, while the preformed body 102 of the support device 101 ensures that the press-fit portions 106*a* of the contact pins 104*a* of the upper row of slits 103*a* are mechanically supported. Within the context of radar housings, it is therefore possible to insert the support assembly 100 into a housing 400 that has received a metal coating prior to insertion of the support assembly 100.

The contact pins 104*a*, 104*b* each have at least one laterally protruding shoulder at the press-fit portion 106*a*, 106*b*, as shown in FIGS. 1A and 1B; in the shown embodiment, the contact pins 104*a* have two laterally protruding shoulders 110*a*, 111*a*. Likewise, the contact pins 104*b* have two shoulders 110*b*, 111*b* which also protrude laterally. In other embodiments, the number of shoulders could be different between the pins 104*a* used in the upper row and the pins 104*b* of the lower row. The shoulders 110*a*, 110*b*, 111*a*, 111*b* facilitate the control of the press-fit. The laterally protruding shoulders 110*a*, 111*a* may receive, if necessary, a push from an outer tool. In other embodiments, the shoulders 110*a*, 111*a* may be omitted.

An electrical connector is connected to the housing 400 and electrical contact is established with the contact portions 105*a*, 105*b*. In the shown embodiment, an electrical connector may be connected to the socket in a direction which is substantially perpendicular to that of the forcible insertion of the substrate. The configuration of the bends 107*a*, 108*a*, 109*a* of the contact pins 104*a* of the upper row and the bends 107*b*, 108*b*, 109*b* of the contact pins 104*b* of the lower row, as well as the bent shape of the preformed body 102 of the support device 101, is chosen depending on the dimensions of the housing 400 and/or of the connection portion of the electrical connector intended to engage the contact portions 105*a*, 105*b*.

Figure 3:
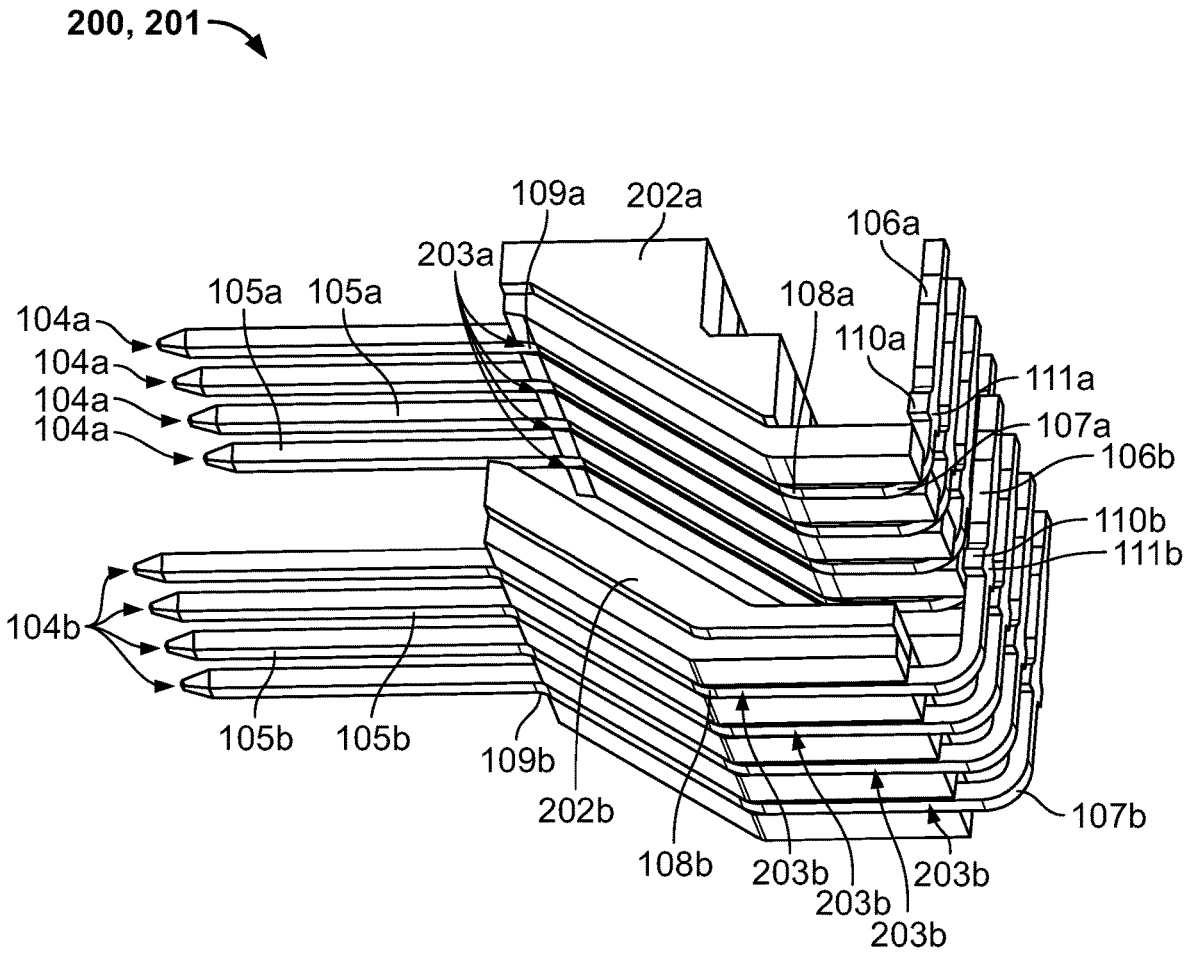
FIG. 3 is a bottom perspective view of a support assembly according to another embodiment.
Figure 4A:
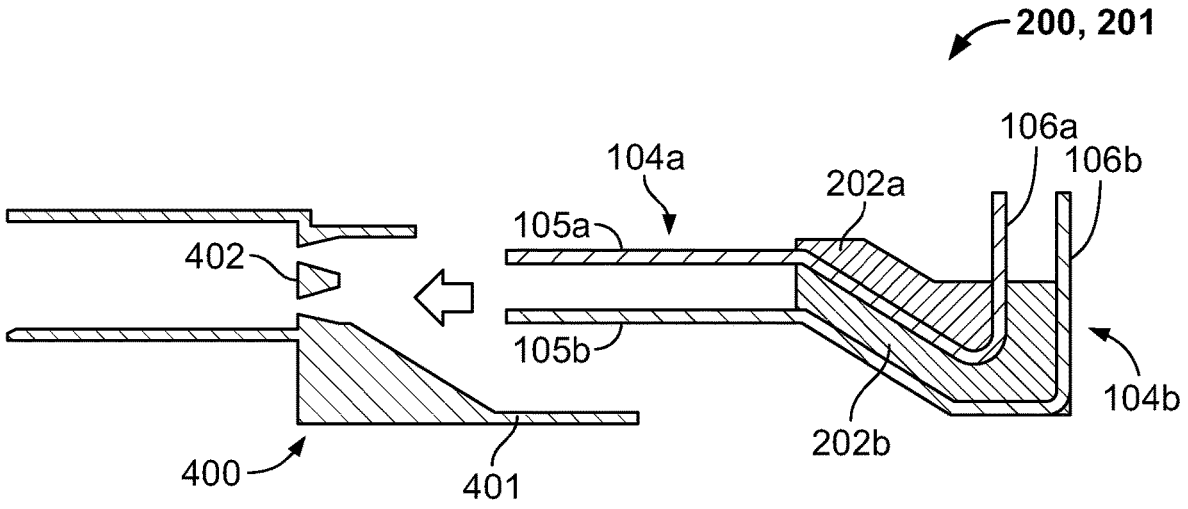
FIG. 4A is a sectional side view of the support assembly of FIG. 3 prior to insertion into a housing.
Figure 4B:
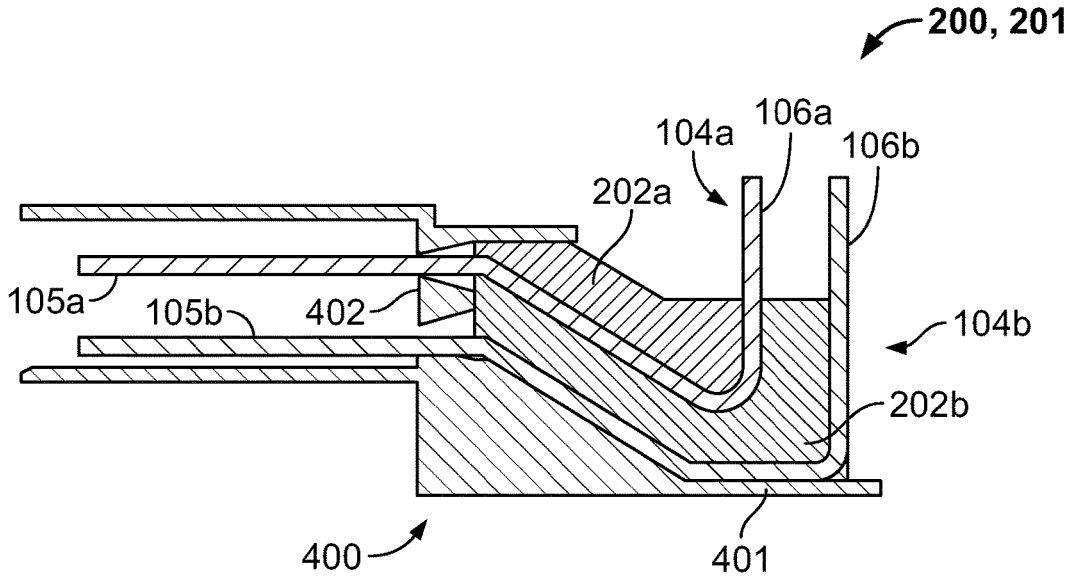
FIG. 4B is a sectional side view of the support assembly of FIG. 3 after insertion into the housing.

A support assembly 200 for press-fit contact pins 104*a*, 104*b* according to another embodiment is shown in FIGS. 3-4B. The support assembly 200, as shown in FIG. 3, has a support device 201 including a preformed body 202. Like reference numbers refer to like elements and the description of the support assembly 200 herein will focus on the differences with respect to the support assembly 100.

In contrast to the support assembly 100 of the embodiment shown in FIGS. 1A and 1B, in the embodiment shown in FIG. 3, the preformed body 202 of the support device 201 comprises two preformed portions 202*a*, 202*b* which are superimposable and/or nestable. The first preformed portion 202*a* is an element made of one single piece having a first row of slits 203*a* formed on the lower face thereof in the illustrated orientation. Likewise, the second preformed portion 202*b* is also an element made of one single piece having a second row of slits 203*b* formed on the lower face thereof in the illustrated orientation. The first row of slits 203*a* and the second row of slits 203*b* are arranged one above the other in a direction of the depth of the preformed portions 202*a*, 202*b*.

As shown in FIG. 3, the press-fit contact pins 104*a*, 104*b* are disposed in the slits 203*a*, 203*b* of the support device 201 in a manner substantially similar to that described with reference to the embodiment of FIGS. 1A-2B. The shown embodiment has two rows which each have four contact pins 104*a* or four contact pins 104*b*, other embodiment may have more or fewer than four press-fit contact pins per row and/or more or fewer than two rows.

The two preformed portions 202*a*, 202*b* are manufactured by a molding process. In an embodiment, the two preformed portions 202*a*, 202*b* are manufactured from the same mold. As shown in FIG. 3, the two preformed portions 202*a*, 202*b* may also be manufactured in different molds, provided the configuration of these portions allows them to be placed on one another and/or nested. Because the two preformed portions 202*a*, 202*b* are manufactured by a molding process, the support assembly 200 represents, like the support assembly 100, a more practical and less costly solution than a support device overmolded around contact pins.

Manufacturing and assembly of the support assembly 200 incorporates the same steps as described for the support assembly 100 above with repeated operations for each of the preformed portions 202*a*, 202*b*. The molding of the preformed portions 202*a*, 202*b* may be performed in parallel. The stamping and the bending of the contact pins 104*a*, 104*b* may also be performed in parallel, as well as the insertion of the contact pins 104*a*, 104*b* into the respective slits 203*a*, 203*b*. The preformed portions 202*a*, 202*b* assembled with the respective rows of contact pins 104*a*, 104*b* are then vertically superimposed and/or nested. In other embodiments, the assembly steps do not need to be performed in parallel and may be performed sequentially.

Once assembled, the support assembly 200 is inserted in the housing 400 as described in the preceding embodiment with reference to FIGS. 2A and 2B. Analogous stages are shown in FIGS. 4A and 4B. The support assembly 200 is introduced into the housing 400 until it rests substantially on the bottom wall 401. Then, as shown in FIG. 4B, the support assembly 200 is slid, horizontally in the depicted orientation, up to the position abutting the contact wall 402 such that the two rows of contact elements 105*a*, 105*b* protrude through the contact wall 402.

Similarly to the preceding embodiment, the support assembly 200 supplies the necessary mechanical support to the press-fit portions 106*a*, 106*b* to withstand the force exerted during a press-fitting. In the embodiment shown in FIG. 4B, the wedging of the support device 201 on the bottom wall 401, at the lower preformed portion 202*b*, ensure that the press-fit portions 106*b* of the contact pins 104*b* accommodated in the row of slits 203*b* are mechanically supported, while the upper preformed portion 202*a* of the support device 201 ensures that the press-fit portions 106*a* of the contact pins 104*a* of the upper row of slits 103*a* are mechanically supported.

Figure 5A:
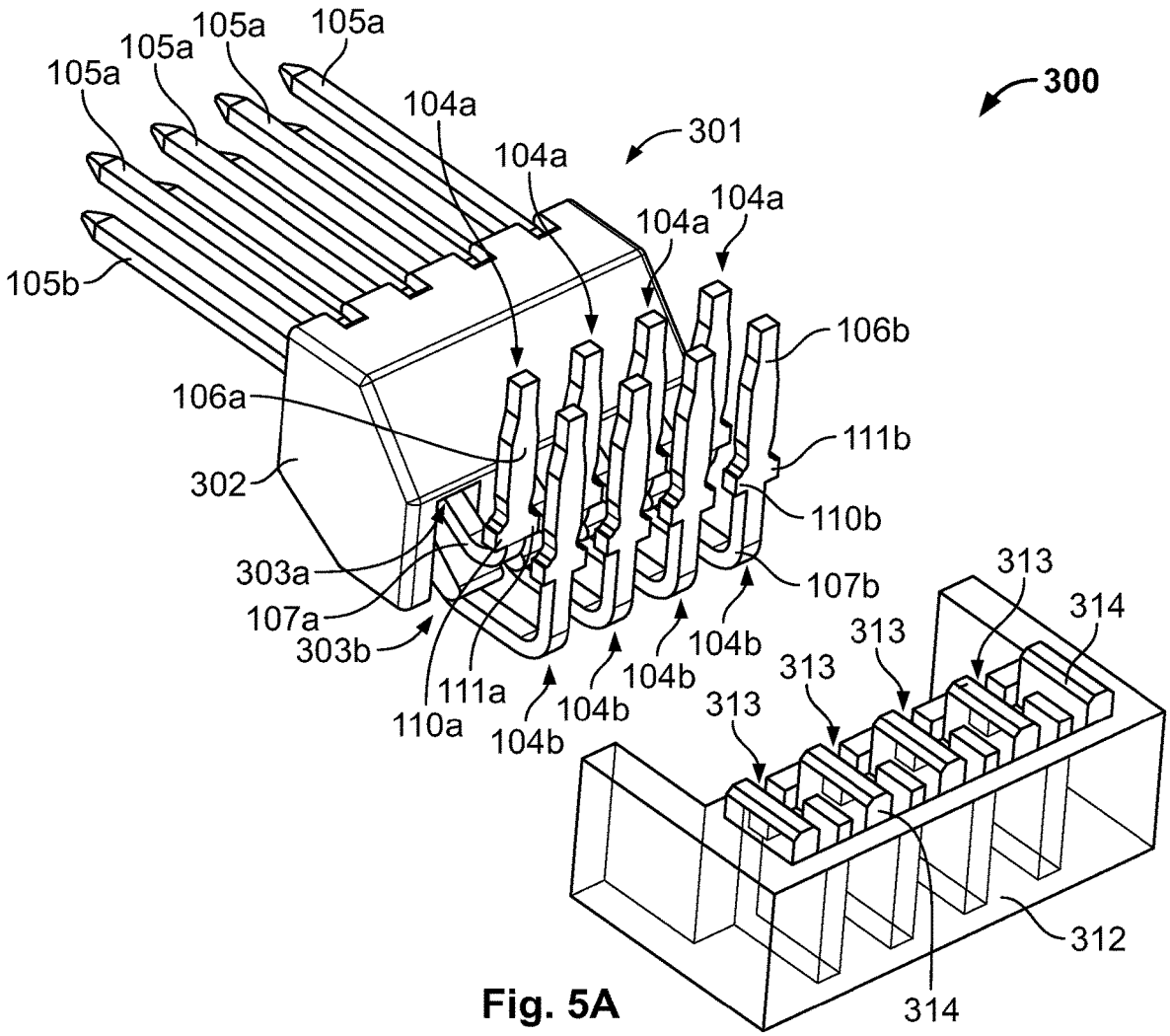
FIG. 5A is a perspective view of a support assembly according to another embodiment of the invention prior to insertion of a wedge of the support assembly.
Figure 5B:
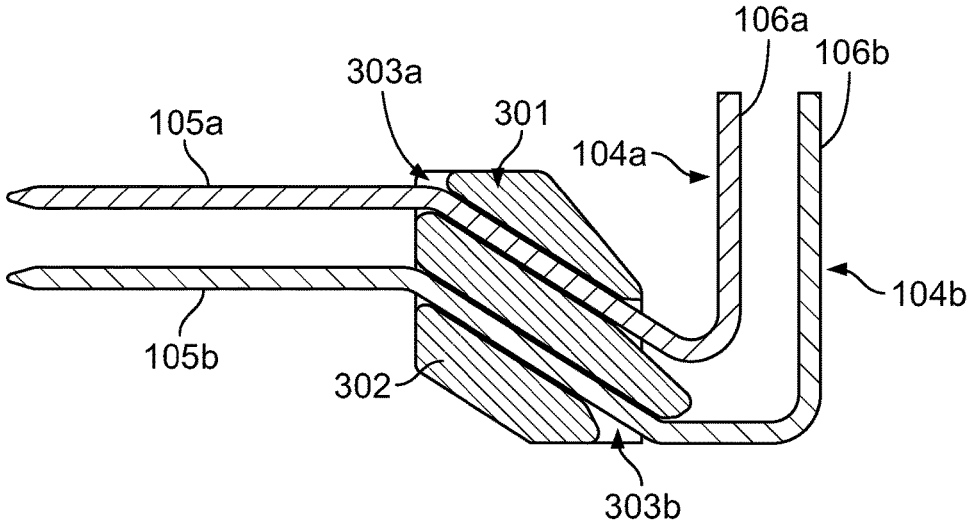
FIG. 5B is a sectional side view of the support assembly of FIG. 5A.
Figure 5C:
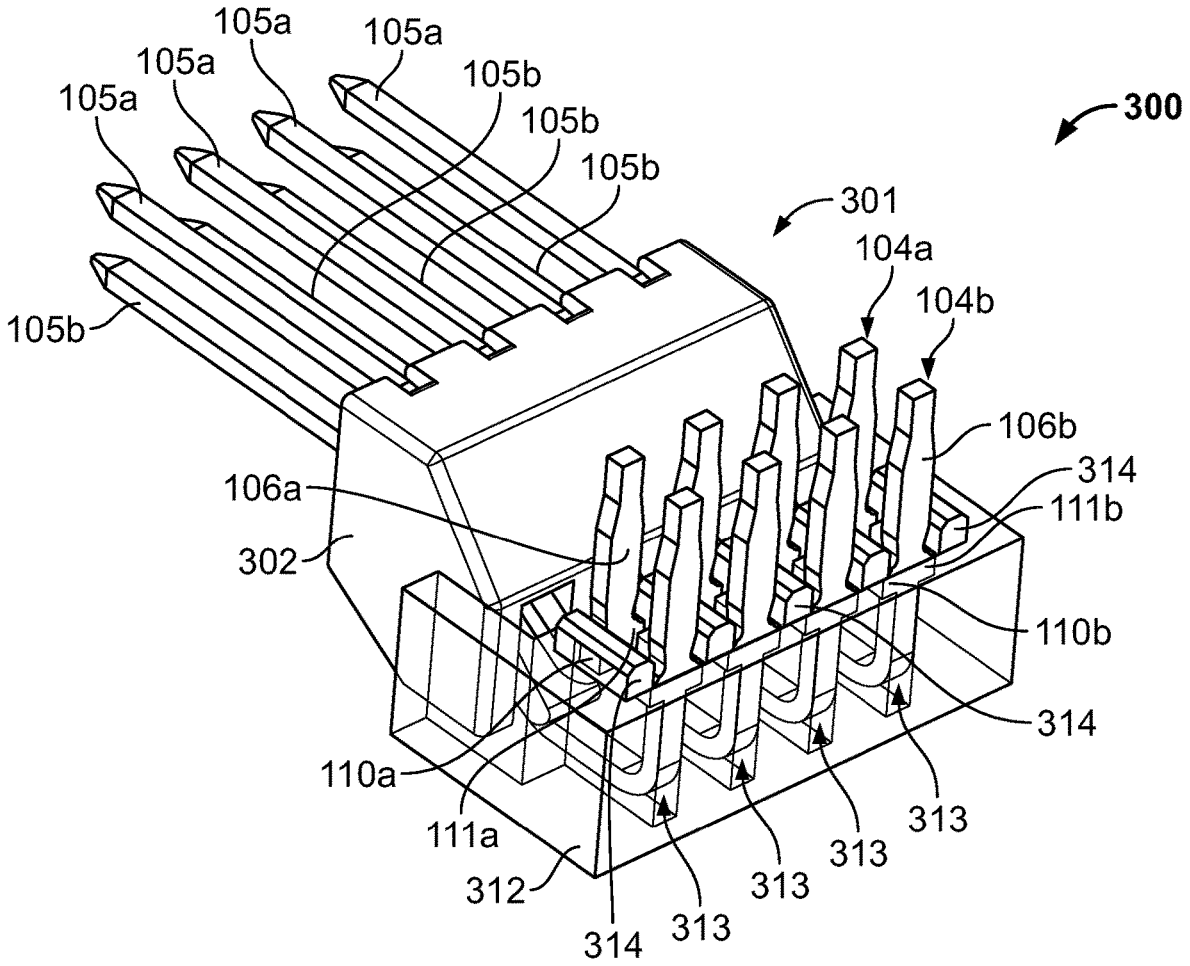
FIG. 5C is a perspective view of the support assembly of FIG. 5A with the wedge inserted.

A support assembly 300 for press-fit contact pins 104*a*, 104*b* according to another embodiment is shown in FIGS. 5A-5C. Like reference numbers refer to like elements and the description of the support assembly 300 herein will focus on the differences with respect to the support assemblies 100 and 200.

As shown in FIG. 5A, the support assembly 300 comprises a support device 301. The support device 301, analogously to the embodiment described with reference to FIGS. 1A and 1B, has a preformed body 302 formed in a single piece and including a first row of holes 303*a* and a second row of holes 303*b*. As shown in FIG. 5B these rows of holes 303*a*, 303*b* extend through the preformed body 302 of the support device 301. Similarly to the preceding embodiments, the first row of holes 303*a*, or the upper row, and the second row of holes 303*b*, or the lower row, are arranged one above the other in a direction of the depth of the preformed body 302. The rows of holes 303*a*, 303*b* of this embodiment substantially have functions similar to those of the slits 103*a*, 103*b* or 203*a*, 203*b* from the preceding embodiments. The press-fit contact pins 104*a*, 104*b* are accommodated in the holes 303*a*, 303*b* of the support device 301.

The preformed portion 302 is manufactured using a simple molding process. In an embodiment, the molding process is performed substantially in parallel with the stamping of the contact pins 104*a*, 104*b*. The contact pins 104*a*, 104*b* are inserted from the rear, from right to left in the orientation of FIG. 5, into the rows of holes 303*a*, 303*b*. In order to accommodate the contact pins 104*a*, 104*b* in the respective rows of holes 303*a*, 303*b*, after the stamping of the contact pins 104*a*, 104*b*, the contact pins 104*a* are inserted into the upper row of holes 303*a*, then the press-fit portions 106*a* may be bent or arched in the direction wished for press-fitting, which frees space and facilitates the insertion of the contact pins 104*b* into the holes 303*b*. Then, the contact pins 104*b* are inserted into the lower row of holes 303*b*, and the press-fit portions 106*b* are bent so as to be aligned with the press-fit portions 106*a* of the contact pins 104*a* of the upper row of holes 303*a*.

The contact portions 105*b* of the contact pins 104*b* of the lower row of holes 303*b* are bent or arched in a direction for electrically contacting an electrical connector, the contact portions 105*b* may be substantially perpendicular to the orientation of the press-fit portions 106*a*, 106*b*. Finally, the contact portions 105*a* of the contact pins 104*a* of the row of upper holes 303*a* are bent so as to be aligned with the contact portions 105*b*. The assembly of the contact pins 104*a*, 104*b* with the preformed portion 302 may also be carried out mechanically as described in the embodiments above.

In the embodiment shown in FIGS. 5A and 5C, the contact pins 104*a* have two laterally protruding shoulders 110*a*, 111*a* and the contact pins 104*b* also have two laterally protruding shoulders 110*b*, 111*b*. The support device 301 of the support assembly 300, as shown in FIGS. 5A and 5C, has a wedge 312 preformed by molding. The wedge 312 is inserted under the shoulders 110*a*, 111*a* and 110*b*, 111*b* of the press-fit portions 106*a*, 106*b*, as shown in FIG. 5C, to provide a supplementary mechanical support when these are subjected to press-fitting or forcible insertion efforts. FIGS. 5A and 5C depict the wedge 312 semi-transparently in order to detail some elements thereof.

As shown in FIGS. 5A and 5C, the wedge 312 has a row of slits 313 receiving the bent portions 107*a*, 107*b* under the shoulders 110*a*, 111*a* and 110*b*, 111*b* of the press-fit portions 106*a*, 106*b*. The wedge 312 thus separates the contact columns and wedges the shoulders 110*a*, 111*a* and 110*b*, 111*b* of the press-fit contact pins 104*a*, 104*b*, transmitting the insertion effort between the bottom of the housing 400 and the press-fit portions 106*a*, 106*b*. In an embodiment, in order to further improve the mechanical support, the wedge 312 has retaining ribs 314. The retaining ribs 314 block a withdrawal movement of the shoulders 110*a*, 111*a* and/or 110*b*, 111*b*.

Other embodiments may be obtained by combining the previously described variants. For example, the different support devices 101, 201, 301 could be placed on one another and/or nested, in order to create configurations with even more rows of contact pins requiring different degrees of mechanical support. In other embodiments, one row of slits could be combined with one row of holes. Furthermore, in each support device 101, 201, 301, more rows and more slits or holes per row, and therefore more contact pins, are also possible. Depending on the type of press-fit connection, it is also not necessary to have the same number of slits and holes, and therefore a same number of contact pins, in each row.

What is claimed is:

1. A support assembly, comprising:

a support device having a body having at least two portions which are superimposable or nestable with a first portion having a first row of slits or holes and a second portion having a second row of slits or holes arranged one above the other in a depth direction of the body;

a plurality of press-fit contact pins:

(a) each having a contact portion at a first end and a press-fit portion at a second end opposite the first end, and (b) each in one of the slits or holes of the first row or the second row with the press-fit portion protruding from a first side of the support device and the contact portion protruding from a second side of the support device opposite the first side and the press-fit portions of the press-fit contact pins in the first row of slits or holes aligned with the press-fit portions of the press-fit contact pins in the second row of slits or holes; and a rib retaining press-fit contact pins in the first row of slits or holes and in the second row of slits or holes.

2. The support assembly of claim 1, wherein the slits or holes of the first row are aligned with the slits or holes of the second row.

3. The support assembly of claim 1, wherein the press-fit portions of the press-fit contact pins extend perpendicularly relative to the contact portions of the press-fit contact pins.

4. The support assembly of claim 1, wherein each of the press-fit portions has at least one laterally protruding shoulder.

5. The support assembly of claim 1, wherein the body is formed in a single piece.

6. The support assembly of claim 5, wherein the first row of slits is disposed in an upper side of the body and the second row of slits is disposed in a lower side of the body opposite the upper side.

7. The support assembly of claim 1 wherein each of the preformed portions has either the first row of slits or the second row of slits.

8. The support assembly of claim 7, wherein the first portion has the first row of slits disposed on a lower side of the first portion.

9. The support assembly of claim 8, wherein the second portion has the second row of slits disposed on a lower side of the second portion.

10. The support assembly of claim 9, wherein the lower side of the first portion is disposed on an upper side of the second portion to form the preformed body.

11. The support assembly of claim 4, wherein the body is in a single piece.

12. The support assembly of claim 11, wherein at least one of the first row of holes and the second row of holes extends through the body.

13. The support assembly of claim 12, further comprising a wedge inserted under the laterally protruding shoulders of the press-fit portions.

14. The support assembly of claim 13, wherein the wedge has a plurality of retaining ribs abutting the laterally protruding shoulders and preventing a withdrawal of the press-fit contact pins.

* * * * *